US011772159B2

(12) United States Patent
Allard et al.

(10) Patent No.: US 11,772,159 B2
(45) Date of Patent: Oct. 3, 2023

(54) METHOD AND APPARATUS FOR THE PRODUCTION OF HIGH PURITY SPHERICAL METALLIC POWDERS FROM A MOLTEN FEEDSTOCK

(71) Applicant: PYROGENESIS CANADA INC., Montreal (CA)

(72) Inventors: Bernard Allard, Beloeil (CA); Pierre Carabin, Montreal (CA); Christopher Alex Dorval Dion, Montreal (CA); Milad Mardan, Montreal (CA); François Proulx, Montreal (CA)

(73) Assignee: PYROGENESIS CANADA INC., Montreal (CA)

( * ) Notice: Subject to any disclaimer, the term of this patent is extended or adjusted under 35 U.S.C. 154(b) by 0 days.

(21) Appl. No.: 16/981,692

(22) PCT Filed: Mar. 18, 2019

(86) PCT No.: PCT/CA2019/000034
§ 371 (c)(1),
(2) Date: Sep. 16, 2020

(87) PCT Pub. No.: WO2019/178668
PCT Pub. Date: Sep. 26, 2019

(65) Prior Publication Data

US 2021/0114104 A1 Apr. 22, 2021

Related U.S. Application Data

(60) Provisional application No. 62/644,459, filed on Mar. 17, 2018.

(51) Int. Cl.
*B22F 9/14* (2006.01)
*B22F 9/08* (2006.01)
(Continued)

(52) U.S. Cl.
CPC ..... *B22F 9/082* (2013.01); *B22F 1/065* (2022.01); *B22F 9/14* (2013.01); *H05H 1/42* (2013.01);
(Continued)

(58) Field of Classification Search
None
See application file for complete search history.

(56) References Cited

U.S. PATENT DOCUMENTS 5,023,425 A 6/1991 Severance, Jr.
5,228,620 A 7/1993 Anderson et al.
(Continued)

FOREIGN PATENT DOCUMENTS

CN 206912255 U * 1/2018

OTHER PUBLICATIONS

English Translation of CN 206912255 U (originally published Jan. 23, 2018) from Espacenet.*

*Primary Examiner* — George Wyszomierski
(74) *Attorney, Agent, or Firm* — Benoit & Côté Inc.; Michel Sofia

(57) ABSTRACT

An apparatus for producing metallic powders from molten feedstock includes a heating source for melting a solid feedstock into a molten feed, and a crucible for containing the molten feed. A liquid feed tube is also provided to feed the molten feed as a molten stream. A plasma source delivers a plasma stream, with the plasma stream being adapted to be accelerated to a supersonic N velocity and being adapted : to then impact the molten stream for producing metallic powders. The feed tube extends from the crucible to a location where a supersonic plasma plume atomizes the molten stream. The plasma source includes at least two plasma torches provided with at least one supersonic nozzle aimed towards the molten stream. The multiple plasma torches are
(Continued)

disposed symmetrically about the location where the supersonic plasma plumes atomize the molten stream, such as in a ring-shaped configuration.

18 Claims, 3 Drawing Sheets

(51) Int. Cl.
*H05H 1/42* (2006.01)
*B22F 1/065* (2022.01)

(52) U.S. Cl.
CPC . *B22F 2009/088* (2013.01); *B22F 2009/0824* (2013.01); *B22F 2009/0832* (2013.01); *B22F 2202/13* (2013.01)

(56) References Cited

U.S. PATENT DOCUMENTS

| | | | | |
|---|---|---|---|---|
| 5,939,151 | A * | 8/1999 | Prichard | H05H 1/48 118/723 VE |
| 6,372,298 | B1 * | 4/2002 | Marantz | B05B 7/224 219/121.5 |
| 2012/0034394 | A1 * | 2/2012 | Shajii | H01J 37/3266 427/571 |
| 2013/0273480 | A1 | 10/2013 | Santoianni et al. | |
| 2016/0175936 | A1 * | 6/2016 | Boulos | B22F 9/14 75/346 |
| 2018/0214956 | A1 * | 8/2018 | Larouche | B22F 9/08 |
| 2020/0180034 | A1 * | 6/2020 | Dorval Dion | B22F 3/003 |

* cited by examiner

METHOD AND APPARATUS FOR THE PRODUCTION OF HIGH PURITY SPHERICAL METALLIC POWDERS FROM A MOLTEN FEEDSTOCK

CROSS REFERENCE TO RELATED APPLICATIONS

This Application is a 371 National Phase filing from International Application No. PCT/CA2019/000034 filed on Mar. 18, 2019, which claims priority on U.S. Provisional Application No. 62/644,459, now expired, filed on Mar. 17, 2018, the entireties of which are herein incorporated by reference.

FIELD

The present subject matter relates to advanced materials and, more particularly, to the production of metal powders for diverse applications, such as additive manufacturing for the aerospace and medical industries.

BACKGROUND

Water atomization uses water as an atomizing medium to atomize a molten stream of metal into very fine particles. Since water is an incompressible fluid, a high pressure jet provides both the density and the velocity required to produce fine powders at large production rates. However, water atomization has several limitations in terms of applications due to contamination from water, and the highly irregular and angular shape of the powder so produced.

As to gas atomization, it can produce metallic powders of high purity by hitting a molten stream with a high pressure inert gas jet. However, this method generally either results in a very low yield as to powders of finer size, or has a relatively low production rate. To achieve a good compromise between both these aspects, very high pressures are required to create a cold supersonic jet. Atomizing with cold gas has the down side of freezing the molten particles too rapidly, which causes gas entrapment within the particles, whereby such powders are less suitable for 3D printing applications, as it affects directly the density of the printed part. Also, due to a fast quenching rate, the shape of the particles is often spheroidal but not spherical. Satellite is also often a problem with this technology, as the large amount of gas used causes intense turbulence powder that forces the recirculation of the finer particles in the cooling chamber.

Turning to plasma atomization, it typically uses a wire instead of a molten stream as a feedstock, and uses a source of plasma (a.k.a. plasma torch) as the atomizing agent to break up the particles. Using a wire provides the stability required to ensure that the narrow plasma jets are aiming property at wire, since the wire has to be melted and atomized in a single step. This technology currently produces the finest, most spherical and densest powder on the market. In other words, the yield of powder produced in the 0-106 micron range is very high, sphericity is near perfect, and gas entrapment is minimized. However, this technology has two main disadvantages. First, dependence on wires as feedstock is significantly limiting, as some materials are too brittle to be made in the form of wire. Using a wire also implies adding cost to the feedstock material as ingots must be melted again so as to be extruded for producing the wire in question. The second major disadvantage is the much lower production rate in comparison to water atomization and to gas atomization. Reported production rates from plasma atomization companies are up to 13 kg/h. An expert in the field would recognize that a more realistic range for optimal particle size distribution would be much lower. For example, U.S. Pat. No. 5,707,419, which is entitled "Method of Production of Metal and Ceramic Powders by Plasma Atomization" and issued in the names of Tsantrizos et al. on Jan. 13, 1998, reports a feed rate of 14.7 g/min or 0.882 kg/h for titanium, while U.S. Patent Application Publication No. 2017/0326649-A1, which is entitled "Process and Apparatus for Producing Powder Particles by Atomization of a Feed Material in the Form of an Elongated Member" and which was published on Nov. 16, 2017 with Boulos et al. as inventors, discloses a reported feed rate of 1.7 kg/h for stainless steel.

Therefore, it would be desirable to provide an apparatus and a method for producing metallic powders from sources other than wires, and at a significant production rate.

SUMMARY

It would thus be desirable to provide a novel apparatus and method for producing metallic powders from molten feedstock.

The embodiments described herein provide in one aspect an apparatus for producing metallic powders from molten feedstock, comprising:

a heating source for melting a solid feedstock Into a molten feed;

a crucible for containing the molten feed;

a delivery system to feed the molten feed as a molten stream; and a plasma source adapted to deliver a plasma stream;

the plasma stream being adapted to be accelerated to a supersonic velocity and being then adapted to impact the molten stream for producing metallic powders.

Also, the embodiments described herein provide in another aspect a process for producing metallic powders from molten feedstock, comprising:

providing a molten feed;

delivering the molten feed as a molten stream;

providing a plasma stream;

accelerating the plasma stream to a supersonic velocity; and impacting the molten stream with a supersonic plasma plume for producing metallic powders.

BRIEF DESCRIPTION OF THE DRAWINGS

For a better understanding of the embodiments described herein and to show more clearly how they may be carried into effect, reference will now be made, by way of example only, to the accompanying drawings, which show at least one exemplary embodiment, and in which.

DESCRIPTION OF VARIOUS EMBODIMENTS

Figure 1:
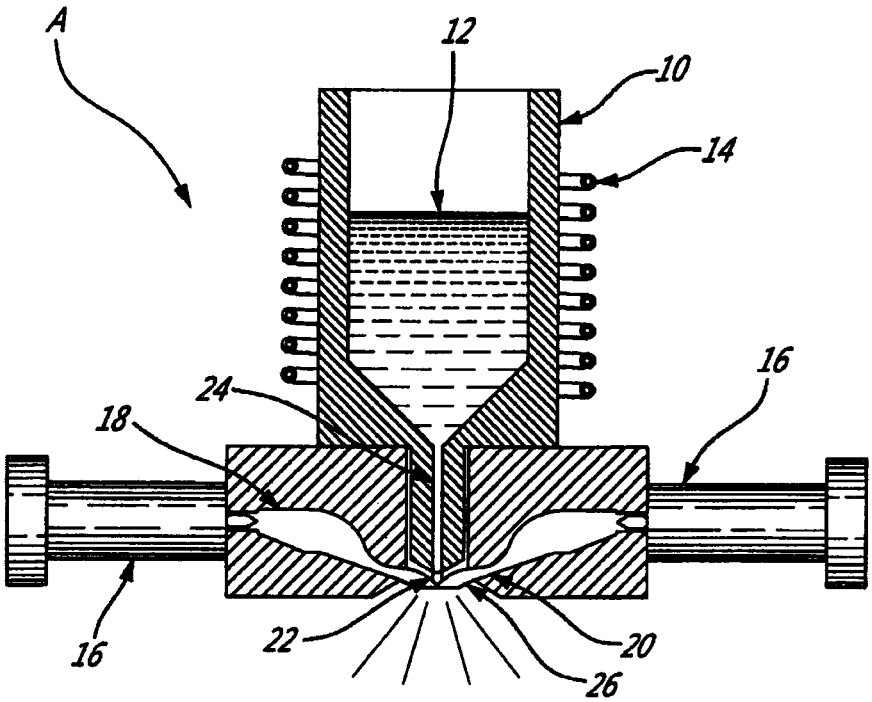
FIG. 1 is a schematic vertical cross-sectional view of an apparatus for producing metallic powders from molten feedstock in accordance with an exemplary embodiment.

The present approach herein disclosed provides methods and apparatuses for producing metallic powders from sources other than wires, such as liquid or solid feedstock.

It is known that wires should be used in order to have a viable plasma-based atomization process. In the present subject matter, a supersonic plasma jet is used to atomize a molten stream, and there follows various embodiments related thereto.

A plasma atomization process that uses a wire ensures that the metal is in proper contact with the plasma jet to maximize heat and momentum transfer, such that the wire can be melted and atomized in a single step. However, there seems to be no physical reasons why the power required to melt continuously the metal should necessarily be provided by the plasma source. In gas and water atomizations, the melting and atomization are two distinct steps. This configuration allows greater production rates, as a result that the melting rate is not limited by the heat transfer and residence time between a supersonic jet and the feedstock.

The present subject matter provides a way to atomize a liquid feed using plasma jets, as in gas and water atomizations.

More particularly, a source of plasma, such as one or multiple plasma torches, is provided to deliver a plasma stream that can be accelerated to supersonic velocity prior to hitting the molten stream with high momentum.

The application of this concept is more complicated in practice than the previous statement may suggest, as supersonic plasma jets can hardly be contained since they create a very harsh environment for materials to survive.

For example, the melting point of Titanium alloy (Ti-6Al-4V) is around 1660° C. In order to provide a proper period of time for the liquid particle to reach a spherical shape, there is delivered a gas jet that is above the melting point of the material to be atomized. For Ti-6Al-4V, a jet temperature of around 1900° C. is preferred. On the basis that supersonic speeds convert thermal heat and pressure into Mach velocities, it is to be expected that the temperature drops significantly between before (upstream of) and after (downstream of) the throat of the supersonic nozzle. Accordingly, to get a Mach jet at 1900° C. at the apex (point of convergence between the plasma jet(s) and the molten stream to be atomized), a temperature above 2500° C. might be required at the inlet of the supersonic nozzle. Considering the heat losses of the high pressure and temperature chamber prior to the nozzle, it can be comfortably stated that the plasma source should have a plume temperature of above 3000° C. Commercial high enthalpy torches can provide this kind of temperature in a reliable way with commercially available spare parts.

Dealing with supersonic plasma jets in a confined area is always delicate. Due to the nature of these jets, there results a very harsh environment for materials to sustain, due to very high temperatures, thermal shocks and mechanical erosion. For this reason, proper materials should be chosen for the design of the plasma path from the torch to the apex. At temperatures above 3000° C., 1 to 2 Mach speed can represent 1500 m/s. Example of materials that can be used are graphite for the chamber, and for the nozzle hard refractory elements that have very high melting point as well as their carbides, such as tungsten, tungsten carbide, titanium carbide, hafnium, hafnium carbide, Niobium, Niobium carbide, tantalum, tantalum carbide, molybdenum, molybdenum carbide, etc. It is also preferable to operate under an inert atmosphere, not only for the quality of the powder produced (to reduce its potential for oxidation), but also to help the survival of the high temperature materials mentioned hereinabove.

The source of plasma stream can come from a single source or a combination of multiple sources, as detailed hereinafter.

Figure 2A:
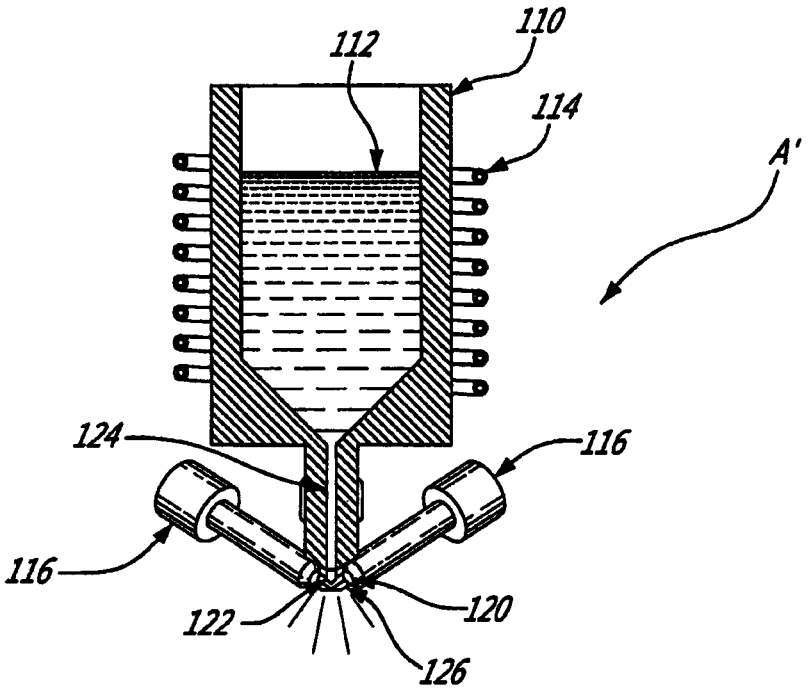
FIG. 2A is a schematic vertical cross-sectional view of another apparatus for producing metallic powders from molten feedstock in accordance with an exemplary embodiment.
Figure 2B:
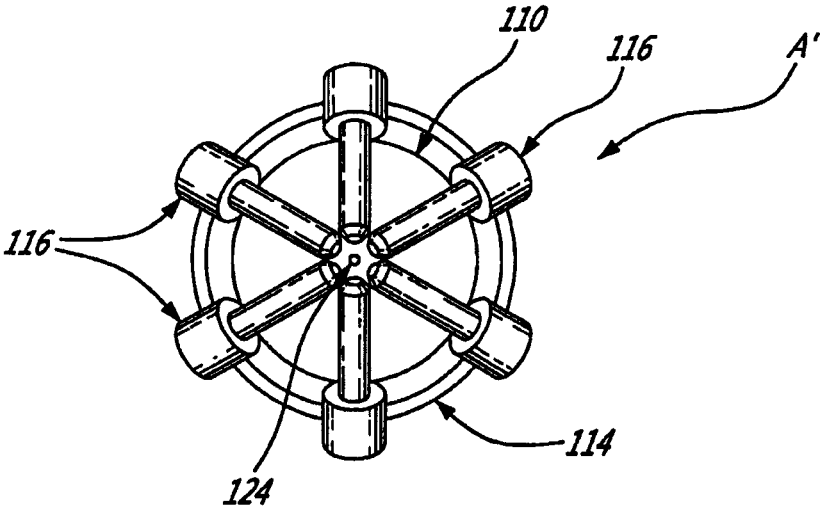
FIG. 2B is a schematic bottom plan view of the apparatus of FIG. 2A.

With reference to FIG. 1 and to FIGS. 2A and 2B, embodiments are shown wherein a feedstock is molten and is fed centrally through a ring of plasma torches, either connected to a gas channel leading to a single annular supersonic nozzle (FIG. 1) or to their individual nozzles (FIGS. 2A and 2B) focused on an apex. The melt can be achieved either through conductive heating from the plasma plume or by any other means of melting the metal. The melt can be directed through the feeding tube by gravity, gas pressure or a piston or any combination thereof.

More particularly, FIG. 1 illustrates an apparatus A for producing metallic powders from molten feedstock, which comprises a melt crucible 10 adapted to contain a melt 12 and heated by induction 14 or otherwise. Multiple commercial plasma torches 16 are connected to a donut-shaped plenum chamber 18. The plasma torch outlets are connected tangentially to force a vortex inside the donut-shaped chamber 18, thereby allowing for a proper plasma gas mixing and uniform mixture. An outlet 20 of the donut-shaped chamber 18 can either be in the shape of a single annular supersonic nozzle aimed towards a molten feedstock stream 22, or it can include multiple supersonic holes (nozzles) also aimed towards the molten stream 22 at the center. A feed tube 24 for the liquid feedstock 22 is provided between the melt crucible 10 and a location where a supersonic plasma plume 26 is adapted to atomize the molten stream.

In FIGS. 2A and 2B, another apparatus A' for producing metallic powders from molten feedstock is shown, wherein a number of small diameter plasma torches 116 are provided with a cylindrical supersonic nozzle being installed on each torch 116. The plasma torches 116 are arranged in a ring-shaped configuration, as best seen in FIG. 2B, and each plasma torch 116 is aimed directly at the falling molten stream (liquid feedstock) 122, the torches being annularly disposed with respect to the molten stream 122. As above, the apparatus A' includes a melt crucible 110 adapted to contain a melt 112 and to be heated by induction 114 or other suitable means. Supersonic nozzles are provided at 120 and are aimed at the molten feedstock stream 122, with supersonic plasma plumes being shown at 126. A feed tube 124 for the liquid feedstock is provided between the melt crucible 110 and a location where the supersonic plasma plumes 126 are adapted to atomize the molten stream.

Figure 3A:
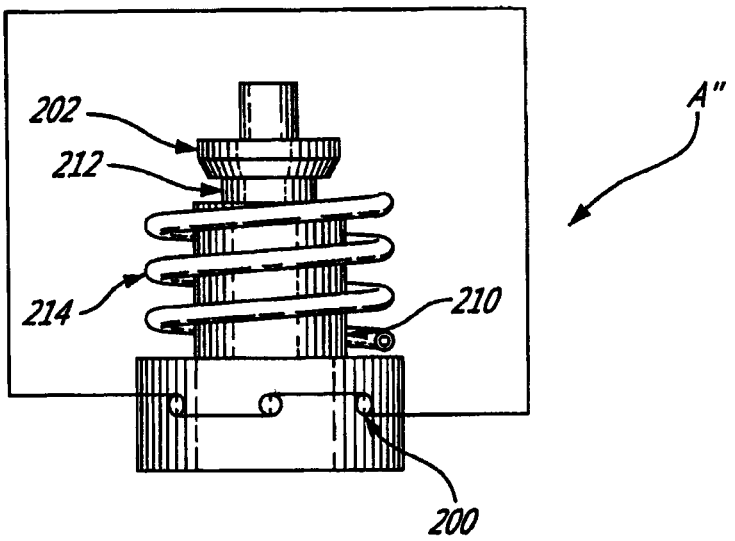
FIG. 3A is a schematic elevational view of an apparatus for producing metallic powders from solid or liquid feedstock in accordance with a further exemplary embodiment.
Figure 3B:
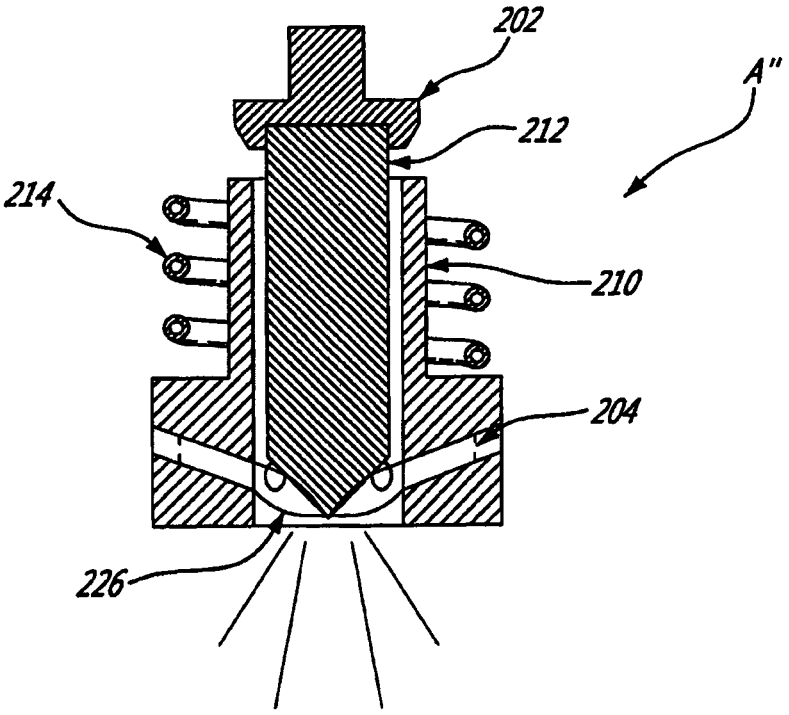
FIG. 3B is a schematic vertical cross-sectional view of the apparatus of FIG. 3A.

Now turning to FIGS. 3A and 3B, there is illustrated thereat a further apparatus A" for producing metallic powders from molten feedstock, but also from solid feedstock. In the method associated with the apparatus A", a solid or liquid feedstock 212 is fed via a crucible/feed guide 210 through an annular plasma torch. The apparatus A" also includes a pusher 202 (for the solid feedstock), but could be combined with a liquid feed instead. The annular torch comprises a set of electrodes 200 put in series which can heat an inert gas to a plasma state and accelerate it to impact a rod of feedstock 212 so as to atomize the feedstock 212. In FIG. 3B, an electric arc is shown at 204 and a plasma plume is denoted by 226. The feedstock 212 can be preheated with induction 214 or resistively.

For each of the above-described apparatuses A, A' and A", in the horizontal axis, it is suggested for the supersonic jets to be aimed with an angle that pushes downward the molten stream (jet).

The molten stream can be obtained from rods or ingot as well as from other sources. The technique(s) used to melt the solid feedstock into a molten stream and to bring the same to the apex zone is irrelevant as long as the appropriate velocity, pressure and temperature are provided by such technique(s).

In the present exemplary embodiments, the plasma source is an arc plasma torch because of its common availability. However, many other ways for achieving the thermal plasma state could be used. For example, inductively-coupled, microwave, and capacitive plasma sources could be used as well.

Another interesting aspect of the present subject matter resides in that, since the gas and/or plasma has such a high temperature at the inlet of the supersonic nozzle, much lower pressures are required to reach Mach speed. Such lower pressures significantly reduce the cost of the installation and the thickness required for the parts. For the exemplary embodiments mentioned hereinabove, an inlet of 10 atm is sufficient to feed the entire setup, while fine particle gas atomization often uses pressures in the order of magnitude of the 40-450 atm.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the embodiments and non-limiting, and it will be understood by persons skilled in the art that other variants and modifications may be made without departing from the scope of the embodiments as defined in the claims appended hereto.

REFERENCES

[1] Peter G. Tsantrizos, Francois Allaire and Majid Entezarian, "Method of Production of Metal and Ceramic Powders by Plasma Atomization", U.S. Pat. No. 5,707,419, Jan. 13, 1998.

[2] Christopher Alex Dorval Dion, William Kreklewetz and Pierre Carabin, "Plasma Apparatus for the Production of High Quality Spherical Powders at High Capacity", PCT Publication No. WO 2016/191854 A1, Dec. 8, 2016.

[3] Michel Drouet, "Methods and Apparatuses for Preparing Spheroidal Powders", PCT Publication No. WO 2011/054113 A1, May 12, 2011.

[4] Maher I. Boulos, Jerzy W. Jurewicz and Alexandre Auger, "Process and Apparatus for Producing Powder Particles by Atomization of a Feed Material in the Form of an Elongated Member", U.S. Patent Application Publication No. 2017/0326649 A1, Nov. 16, 2017.

[5] "Titanium MIM Moves into the Mainstream with Plasma Atomised Powders from AP&C", Powder Injection Moulding International, Vol. 11, No. 2, June 2017.

The invention claimed is:

1. An apparatus for producing metallic powders from molten feedstock, comprising:

a heating source for melting a solid feedstock into a molten feed;

a crucible for containing the molten feed;

a delivery system to feed the molten feed as a molten stream; and a plasma source adapted to deliver a plasma stream;

the plasma stream being adapted to be accelerated to a supersonic velocity and being then adapted to impact the molten stream for producing metallic powders, wherein the plasma source includes at least two plasma torches connected to a plenum chamber, and wherein the molten feed is fed centrally through a ring of plasma torches, connected to a gas channel leading to a single annular supersonic nozzle.

2. The apparatus as defined in claim 1, wherein the delivery system includes a liquid feed tube extending from the crucible such as to deliver the molten feed downstream to a location where a supersonic plasma plume is adapted to atomize the molten stream.

3. The apparatus as defined in claim 1, wherein the plenum chamber is donut-shaped.

4. The apparatus as defined in claim 1, wherein outlets of the plasma torches are connected tangentially to force a vortex inside the plenum chamber.

5. The apparatus as defined in claim 1, wherein an outlet of the plenum chamber includes one of a single annular supersonic nozzle aimed towards the molten stream and multiple supersonic holes aimed towards the molten stream.

6. The apparatus as defined in claim 1, wherein the plasma source includes at least two plasma torches each provided with a cylindrical supersonic nozzle, disposed symmetrically about the location where supersonic plasma plumes atomize the molten stream.

7. The apparatus as defined in claim 6, wherein the plasma torches are arranged in a ring-shaped configuration, with each plasma torch being aimed directly at the molten stream exiting the delivery system, and wherein the torches are annularly disposed with respect to the molten stream.

8. The apparatus as defined in claim 1, wherein the molten feed is adapted to be directed through the delivery system by at least one of gravity, gas pressure and a piston.

9. The apparatus as defined in claim 1, wherein the plasma source includes an arc plasma torch.

10. The apparatus as defined in claim 1, wherein the plasma source includes at least one of inductively-coupled, microwave, and capacitive plasma sources.

11. The apparatus as defined in claim 1, wherein an outlet of the plenum chamber includes multiple supersonic holes aimed towards the molten stream, with the supersonic holes including nozzles.

12. The apparatus as defined in claim 11, wherein the supersonic holes are centrally aimed at the molten stream.

13. An apparatus for producing metallic powders from feedstock, the feedstock including one of a molten feedstock and a solid feedstock, comprising:

a delivery system to feed the feedstock; and a plasma source adapted to deliver a plasma stream;

the plasma stream being adapted to be accelerated to a supersonic velocity and being then adapted to impact the feedstock for producing metallic powders, wherein the plasma source includes an annular plasma torch, and wherein the solid feedstock or the liquid feedstock is adapted to be fed respectively via a feed guide or a crucible through the annular plasma torch.

14. The apparatus as defined in claim 13, wherein a pusher is provided for feeding the solid feedstock to the annular plasma torch, and wherein the pusher is adapted to feed the solid feedstock through the feed guide, upstream of the annular plasma torch.

15. The apparatus as defined in claim 13, wherein the annular plasma torch includes a set of electrodes put in series and adapted to heat an inert gas to a plasma state and accelerate it to impact the solid feedstock so as to atomize the solid feedstock.

16. The apparatus as defined in claim 15, wherein the electrodes are circularly disposed.

17. The apparatus as defined in claim 13, wherein the solid feedstock is adapted to be preheated with induction or resistively.

18. An apparatus for producing metallic powders from molten feedstock, comprising:

a heating source for melting a solid feedstock into a molten feed;

a crucible for containing the molten feed;

a delivery system to feed the molten feed as a molten stream; and a plasma source adapted to deliver a plasma stream;

the plasma stream being adapted to be accelerated to a supersonic velocity and being then adapted to impact the molten stream for producing metallic powders, wherein supersonic jets of the plasma stream are aimed with an angle such as to push downstream the molten stream.

* * * * *